US005259508A

United States Patent [19]

Beckerman

[11] Patent Number: 5,259,508

[45] Date of Patent: Nov. 9, 1993

[54] PROTECTIVE SHIPPING PACKAGE

[76] Inventor: Stephen M. Beckerman, 30 Tanglewood Dr., Livingston, N.J. 07039

[21] Appl. No.: 937,058

[22] Filed: Aug. 27, 1992

[51] Int. Cl.[5] ..... B65D 81/04

[52] U.S. Cl. ..... 206/587; 206/594

[58] Field of Search ..... 206/591, 592, 594, 587, 206/564

[56] References Cited

U.S. PATENT DOCUMENTS

| | | | |
|---|---|---|---|
| 1,840,677 | 5/1930 | Miessler . | |
| 1,892,527 | 4/1929 | Gray . | |
| 2,160,816 | 10/1936 | Barnes . | |
| 2,176,274 | 10/1939 | Parnin | 206/592 X |
| 2,330,347 | 4/1942 | Elliott . | |
| 2,553,418 | 5/1951 | Loth | 206/591 X |
| 2,561,260 | 10/1947 | Yaupp . | |
| 2,835,428 | 11/1955 | Herzog . | |
| 2,877,942 | 3/1959 | Antwerpen . | |
| 2,908,437 | 9/1956 | Wiedenmeier . | |
| 3,023,885 | 3/1960 | Kindseth . | |
| 3,079,061 | 8/1961 | Wojcik . | |
| 3,158,307 | 5/1962 | Mayer . | |
| 3,217,960 | 6/1963 | Davis . | |
| 4,415,086 | 11/1983 | Bennett, Jr. | 206/564 |
| 4,754,883 | 7/1988 | Grzywa | 206/564 |

FOREIGN PATENT DOCUMENTS

| | | | |
|---|---|---|---|
| 2455811 | 11/1974 | Fed. Rep. of Germany . | |
| 2402598 | 9/1977 | France . | |
| 1-27265 | 5/1990 | Japan | 206/587 |
| 1277433 | 6/1972 | United Kingdom . | |

OTHER PUBLICATIONS

Sales brochure from Fibercel Corporation, entitled "RCF Innovative Packaging Manufactured from our two most renewable resources" (no date).

Products offered by Henry Molded Products, Inc. (photographs of two products attached) no date available.

*Primary Examiner*—William I. Price

*Attorney, Agent, or Firm*—Lerner, David, Littenberg, Krumholz & Mentlik

[57] ABSTRACT

An apparatus providing a shock absorbant cap for a product, the cap having a base, a plurality of product positioning structures rising out of and around the edges of the base and defining a product cavity, and a plurality of resilient spring walls connected to the product positioning structures and extending downwardly and outwardly therefrom, the spring walls connecting each other at corners. Preferably, a product is placed in the product cavity and the cap is placed in a rigid container. Additionally, the spring walls may be concave or convex at their outer edges.

51 Claims, 6 Drawing Sheets

PROTECTIVE SHIPPING PACKAGE

BACKGROUND OF THE INVENTION

This invention pertains to shipping packages for products which require protection from the vibration and impacts which occur during handling and transportation.

During shipment, packages containing breakable products are subjected to vibrations and to many impact shocks from being dropped from heights of 36 inches or higher. The magnitude of these impacts can be as high as 700 Gs (700 times the force of gravity) and more. The cushioning medium of the package must "dampen" these shocks to a level of impact which the packaged product can sustain and still function satisfactorily. The "impact rating" of a product defines the maximum impact the product can safely sustain without damage Corrugated cardboard, and certain arrangements of folded corrugated cardboard, have been used to protect and cushion more durable products, such as radios, toasters, and the like. However, corrugated cardboard is generally ill-suited to today's more delicate items. Molded paper fiber has been used to some extent for packaging of durable products, but was often too stiff or ineffective for the packaging requirements of many products.

For more fragile and sensitive items, foam-type packaging has been used to protect the products. For example, semi-rigid expanded polystyrene has been used to protect fragile items rated in the 40 to 120 G range, such as televisions and computer terminals. Flexible urethane, polypropylene and polyethylene have been used to package the most sensitive products such as medical equipment and hard disk drives, which are often rated within the 20 to 40 G range. Packaging made of such polymers uses the resiliency of the material itself to cushion the product from harsh impacts by providing a material which crushes and absorbs energy upon impact, thereby decelerating the package product in a gradual manner.

While polymer packaging is quite effective at protecting fragile products, use of such packaging has been discouraged as being harmful to the environment. Foam packaging is traditionally made from petroleum, a diminishing resource, and the manufacture of foam often releases destructive hydrochlorofluorocarbons. Further, foam tends not to decompose, and takes up valuable landfill space.

The present invention provides an arrangement to meet those needs.

SUMMARY OF THE INVENTION

The present invention provides the cushioning protection of foam while permitting the use of other materials, such as those which are biodegradable.

The present invention provides a package including a rigid container with a plurality of sides, a bottom and a top defining a chamber. The package also includes a cap having a base, a plurality of product positioning structures, and a plurality of resilient spring walls. The base has a top, bottom, and a plurality of edges, such that the plurality of edges define a perimeter. The product positioning structures are disposed along the edges of the base, such that the structures have a bottom connected to the base and a top disposed above the base. The product positioning structures and base cooperatively define a product cavity for positioning a product within this product cavity. The resilient spring walls extend alongside the edges of the base, and have an inner edge connected to the tops of the product positioning structures. The spring walls also extend downwardly and outwardly from the tops of the product positioning structures so that the outer edge of each spring wall is at a position outside of the base perimeter. At least two of the spring walls join one another at a corner.

If the container is impacted in an impact direction, the base within the container travels in a direction opposite the impact direction towards one of the sides of the container, and a portion of the spring walls compresses towards the product positioning structures thereby decelerating the product.

In one preferred embodiment, the outer edges of the spring wall are concave in a direction toward the base. In another preferred embodiment, the outer edges of the spring wall are convex in a direction outward from the base. Alternatively, the outer edges may be straight.

Desirably, the carton is made of corrugated cardboard, and has a bursting strength of 275 pounds per square inch.

The package preferably includes a resilient product cover whereby the cap is placed along the bottom of the carton and the product cover is placed along the top. The product is placed within the product cavity of the cap and against the product cover such that the product is resiliently suspended between the cap and product cover. Desirably, the structure of the product cover is identical to the cap structure. Together, the cap and product cover are capable of protecting the products with impact ratings of 30 Gs or greater from drops of 36 inches or greater.

Another aspect of the present invention includes a shock absorbant cap, which has a similar base, product positioning structures, and spring walls connected at corners as the cap of the package described above. In this other aspect of the present invention, the outer edges of the spring walls are concave in the direction of the base. Alternatively, the outer edges of the spring walls may be convex in a direction outward from the base.

In another preferred embodiment of the present invention, the outer edges of at least two spring walls are connected at the corners.

In yet another preferred embodiment of the present invention, a majority of the base defines a base plane, with the outer edges of the spring walls extending below the base plane, and closer to the bottom of the base than the top.

In still another preferred embodiment, the cap is desirably made of molded paper fiber, the number of edges of the base is four, and the number of spring walls is four. The products for use with the package and shock absorbant caps weigh between about 10 and 100 pounds (4.5–45 kg). Further, the base is about 14.5 inches wide, about 16 inches long, and about 0.25 inches thick. The dimensions of the skirt are about 21 inches by 21 inches, and the skirt is about 3.5 inches long at its shortest point between the product positioning structures and the outer edge.

It is also preferable for the corners to be rounded. Desirably, the radius of at least one corner at the outer edge is greater than the corner's radius closer to the product positioning structures. The radius of a corner progressively decreases from the outer edge of the corner towards the product positioning structures.

Desirably, the base defines a base plane, and the slope of the spring walls with respect to the base plane is between about 45 degrees and 80 degrees. Further, the slope of the spring wall progressively increases towards the ends of the outer edges, and progressively decreases towards the midpoint of the outer edge ends. In one preferred embodiment, the slope of the spring walls at every point is between about 60 degrees to 75 degrees, such that the slope at said midpoint of the outer edges is about 75 degrees, and the slope at said corners is about 60 degrees.

In another preferred embodiment of the present invention, the spring walls may include a skirt and a flange, with the skirt extending downwardly from the inner edge of the spring wall to a bottom which is a spaced distance from the base's perimeter. The flange is connected to the bottom of the skirt, and extends to the spring wall's outer edge, whereby the flange and skirt form an angle. The angle between the flange and the skirt is between about 90 degrees and 135 degrees.

In yet another preferred embodiment, the present invention includes spacer structures disposed between the product positioning structures. The spacers have an inner wall rising out of the perimeter of the base, with the spring walls capable of contacting the inner walls if the spring walls are flexed towards the base.

DETAILED DESCRIPTION OF THE PREFERRED EMBODIMENTS

The present invention positions a product a spaced distance away from the walls of a carton and provides an effective energy-absorbing device between the product and the carton walls.

A protective cap 10 in accordance with one embodiment of the present invention is made of a material which is semi-rigid, such as molded paper fiber, or preferably, recycled paper fiber. The recycled paper fiber can be comprised of newsprint, newsboard, kraft fiber, paper fiber, and other cellulosic fibers.

The cap 10 includes base 12, with a top and a bottom. A majority of the points of the base define a plane referred to as the base plane, and the top of the base is on one side of the base plane, and the bottom of the base is on the other side of the base plane. Generally, directions referred to as "upward" or "rising" shall refer to the direction orthogonal to the base plane and away from the top of base 12, and directions referred to as "downward" shall refer to the direction orthogonal to the base plane and opposite the upward direction. The term "above" a reference point shall refer to a point upward of the reference point, and the term "below" a reference point shall refer to a point downward of the reference point. The base has a center and a perimeter, the perimeter being defined by its outer edges 17. Points referenced as being "beyond (or outside) the perimeter of the base" shall mean a point which is disposed outside of the polygonal space defined by the collection of planes intersecting the outer edges 17 and infinitely extending orthogonal to the base plane. The direction "inward" shall refer to the direction towards the center of base 12, and "outward" shall refer to the direction away from the center of base 12.

Figure 3:
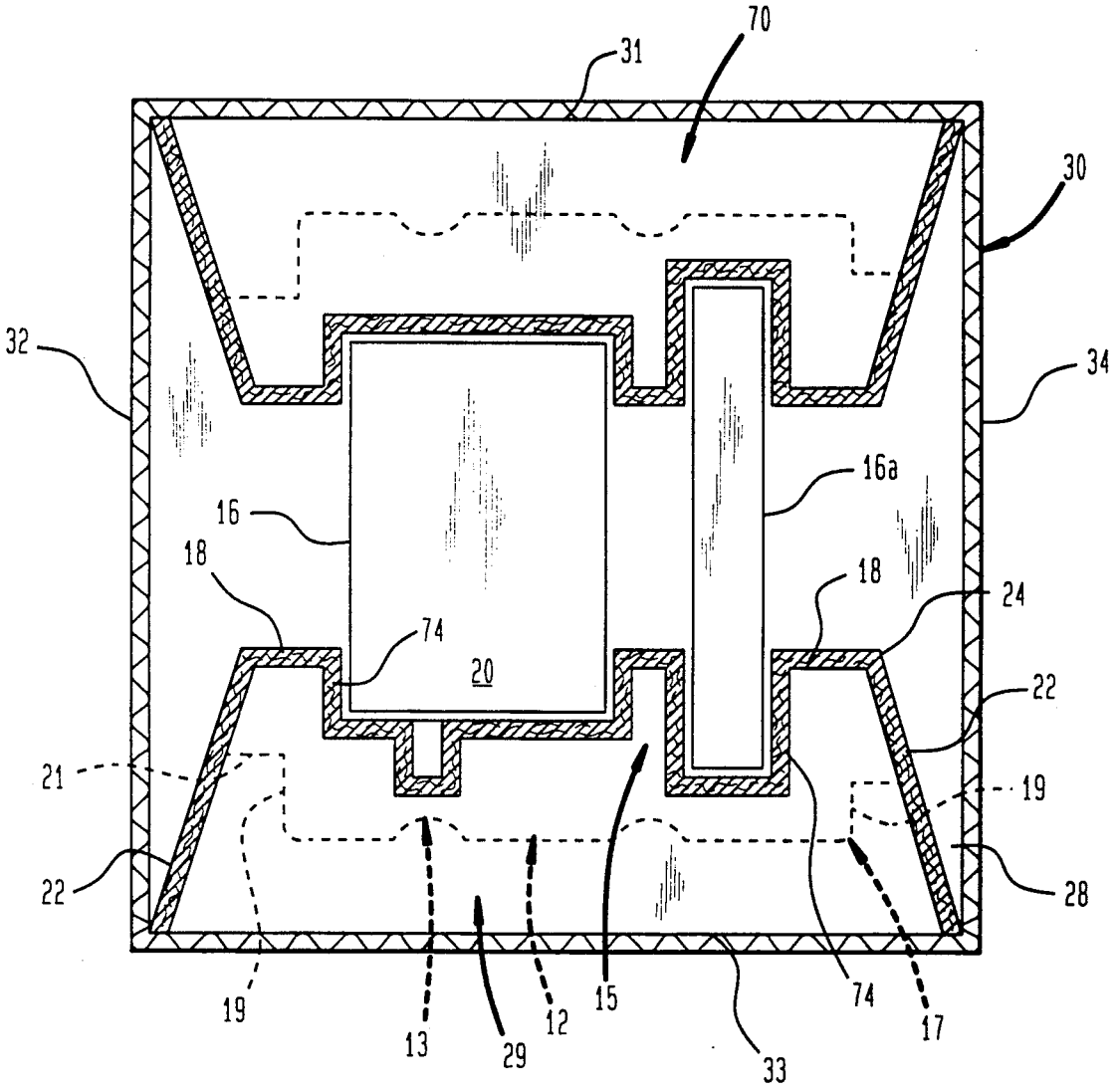
FIG. 3 is a cross-sectional view of a preferred embodiment of the present invention in a carton.

Rising upward from the base are high ribs 15, which usually have planar sides 73 substantially orthogonal to the base plane and connected to the top of base 12, and also have planar tops 72 parallel to the base plane and connected to the planar sides 73. As shown in FIG. 3, either the tops, sides or both the tops and sides of high ribs 15 may engage a product 16 or 16*a*. Low ribs 13, like the high ribs 15, also rise upwardly out of the base, have planar tops substantially parallel to the base plane, and have planar sides orthogonal to the base plane. However, neither the tops nor the sides of low ribs 13 engage the product.

Figure 1:
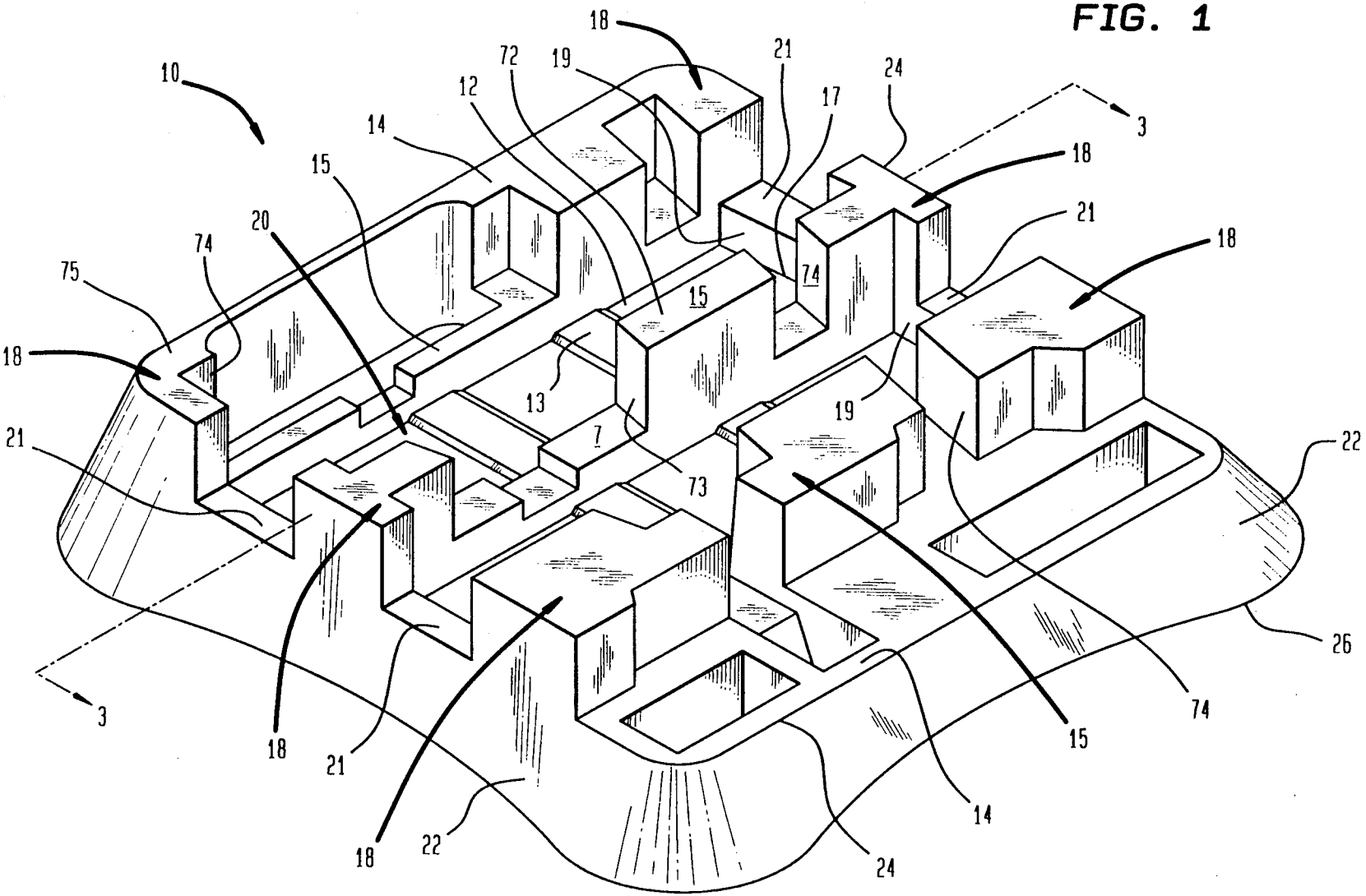
FIG. 1 is an isometric view of a preferred embodiment of the present invention.

Around the outer edges 17 of base 12, a plurality of product positioning structures such as 18 rise out of base 12. Product positioning structures 18 have planar sides 74 substantially orthogonal to the base plane and connected to the top of base 12, and have planar tops 75 substantially parallel to the base plane and connected to the planar sides 74. The side 74 of the product positioning structures 18 which is closest to the center of base 12 usually engages a product 16 or 16*a*. The totality of product positioning structures 18 form a product cavity 20, which in FIG. 3 is occupied by products 16 and 16*a*, and ribs 13 and 15. The edge along the top 75 of the product positioning structures 18 farthest from the center of base 12 is top edge 24. The top edge 24 of the preferred embodiment of FIG. 1 is disposed outside the perimeter of base 12. Preferably, top 75 of the product positioning structures will extend from top edge 24 to the product, if a product is engaged by the product positioning structure.

Spacers 21 extend between neighboring product positioning structures 18. The spacers are similar to product positioning structures 18, except that they do not directly contact the product. Each of the spacer has an inner wall 19, which is substantially orthogonal to the base plane, and rises out of outer edges 17 of base 12. Generally, the tops of spacers 21 are not as far above the base 12 as tops 75 of product positioning structures 18.

Connected to top edge 24 of product positioning structures 18 is skirt 22. Skirt 22 extends downwardly from the top edge, towards an outer edge 26 which is outside the perimeter of base 12. As shown in FIG. 3, the outer edge 26 is below the base plane.

Because the skirt extends outwardly and downwardly away from top edge 24, the skirt will be at an angle to base 12. The slope of the skirt at any reference point along the outer edge of the skirt may be defined as the shortest angle between the base plane, and the line which intersects the reference point along the outer edge 26 and the point along top edge 24 which is closest to the reference point.

Figure 2:
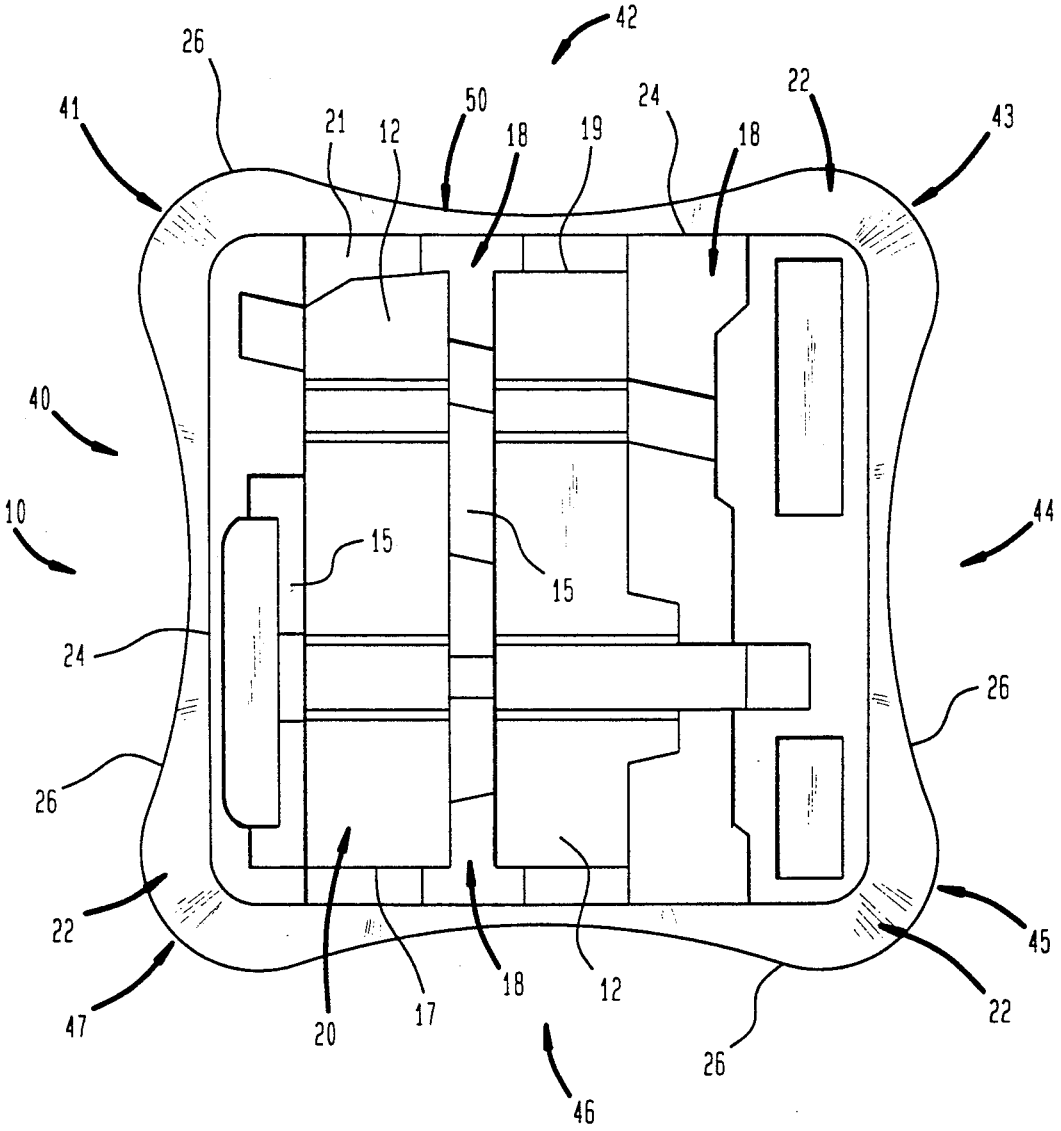
FIG. 2 is a top view of a preferred embodiment of the present invention.

As shown in FIG. 2, the outer edge 26 of skirt 22 extends continuously about the cap, such that the outer edge of the skirt along one side of the cap is connected to the outer edges of the skirts at the neighboring sides. For example, the outer edge 26 along side 44 is connected to the outer edge 26 along neighboring sides 42 and 46 at corners 43 and 45, respectively. Thus, the outer edges of the skirts are connected at the four corners 41, 43, 45 and 47.

Preferably, the corners 41, 43, 45, and 47 are rounded. Further, it is desirable for the top edges 24 of the product positioning structures 18 at the corners to be rounded. The radius of the corner closest to top edge 24 is smaller than the radius of the corner at outer edge 26.

As seen in FIG. 2, the outer edge of the skirts is concave in the direction of base 12 between the corners of the skirt. Thus, rounded corners 41, 43, 45, and 47 will extend farther beyond the perimeter of base 12 than the rest of the skirt. The concavity of the outer edges of skirt 22 may be accomplished by progressively increasing the slope of the skirt as it approaches the middle portions 50 between the corners. The slope of the skirt reaches a maximum at the midpoint between corners. As shown, the top edge 24 is linear while the outer sides are concave. Preferably, the slope at the corners is about 60 degrees, and the slope at the midpoint is about 75 degrees.

While the molded paper fiber material is resistant to deformation, it is resilient to a certain degree such that it may flex and absorb energy under pressure, is capable of deforming from its position without fracture, and will recover its pre-deformation configuration in the absence of other forces. In other words, if product positioning structure 18 remains steady and a force is applied to outer edge 26 of skirt 22, the skirt will tend to resist the force, but will deflect inwardly under the strain absorbing energy as it does. When the force at outer edge 26 is terminated, skirt 22 will move back to its original position with respect to product positioning structure 18. In essence, skirt 22 acts as a spring with the ability to deflect and absorb energy. Desirably, the skirt will gently recover completely or partially to its rest position after deviation due to outside forces. The term "spring" does not necessarily mean that the skirt is perfectly elastic, but merely implies that the skirt opposes deformation and recovers its rest position after deformation.

In operation, a cap 10 is placed along the bottom 33 of a corrugated cardboard carton 30, such that the base plane is substantially parallel to bottom 33. As seen in FIG. 3, because the outer edge 26 extends below the base plane, base 12 is suspended a spaced distance 29 above the bottom 33 of carton 30. Preferably, the outer edge 26 of skirt 22 extends to and abuts all four sides of the carton 30, such as sides 32 and 34. Because the skirt 22 is disposed at an angle with respect to the base plane, there will be a space 28 between skirt 22 and side 34 of carton 30.

After cap 10 has been placed in the bottom of the carton, products 16 and **16*a* are fitted within product cavity 20 by placement between ribs 15 and product positioning structures 18. After products 16 and 16*a* are positioned, a second cap 20 is similarly placed over the product and the carton is closed. Cap 20 is often a mirror-image of cap 10, with the identical operation as cap 10**.

The caps 10 and 20 cooperate to protect the product from damage due to impact or vibration. Damage to the product due to impact or jarring can be reduced or eliminated if a mechanism is provided to decelerate the product at a safe rate for that product, so that the residual impact if any is soft enough to be cushioned adequately by the mechanism itself. Further, damage due to vibration can be reduced or eliminated if the mechanism is capable of absorbing all or most of the oscillations caused by the vibration.

Figure 4:
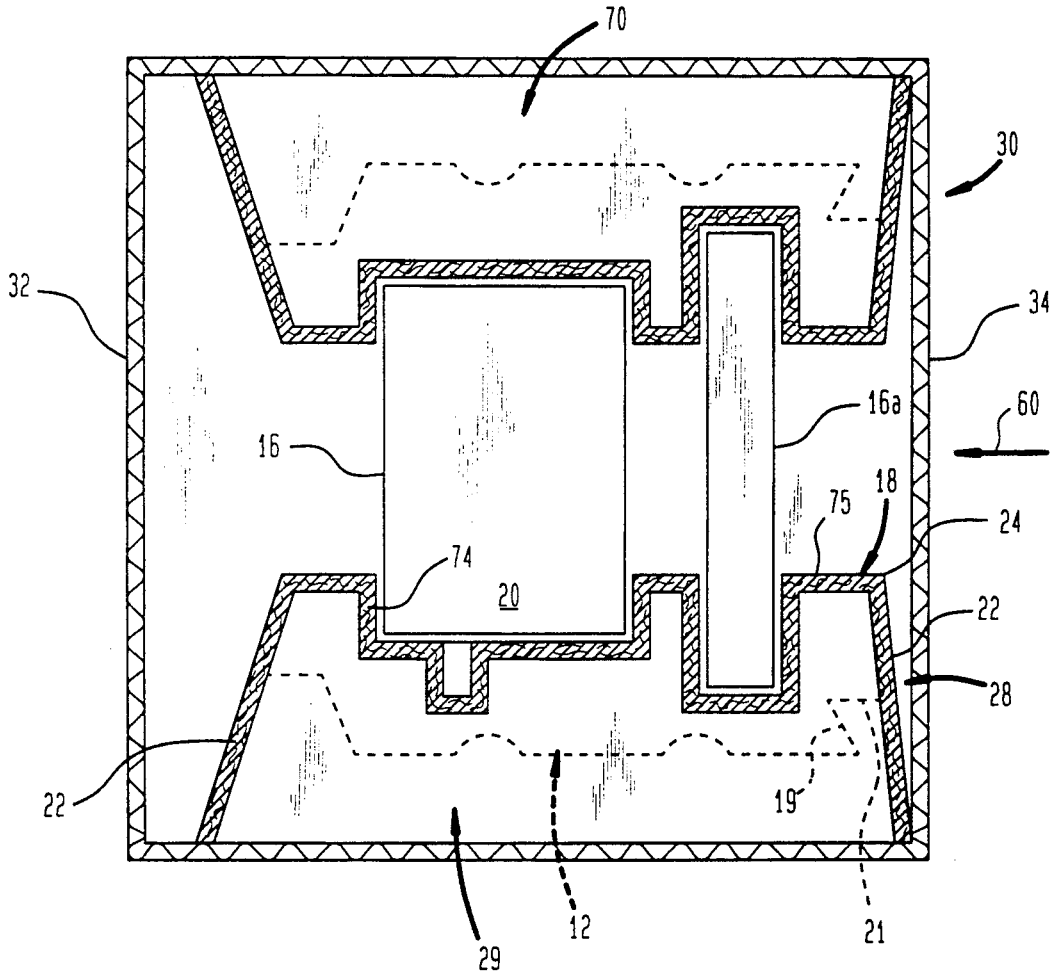
FIG. 4 is a cross-sectional view of a preferred embodiment of the present invention in a carton shortly after an impact.
Figure 5:
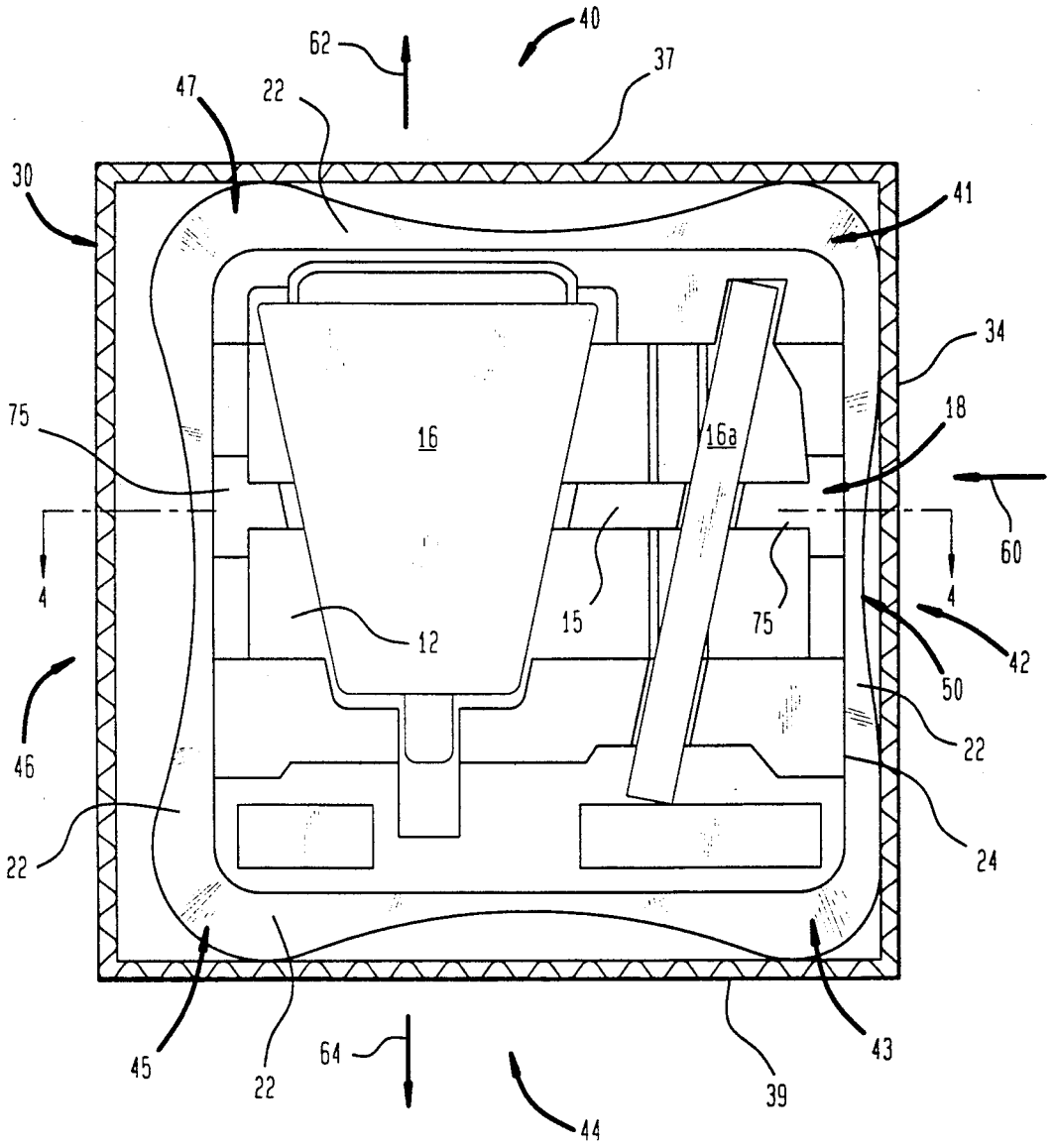
FIG. 5 is a top view of the present invention shortly after an impact.

FIGS. 4 and 5 illustrate the operation of providing safe deceleration in response to an impact. By way of example, the carton is assumed to be dropped on side 34 and suddenly stopped in its motion as it hits the floor. The direction of the impact to the carton from the floor is referenced by arrow 60. Depending on the height of the drop, the carton can achieve a relatively high velocity and momentum before hitting the floor.

During impact with the floor, although the carton 30 may have stopped, the momentum of cap 10 and products 16 and **16*a* will cause the cap and product to continue travelling in the direction opposite to the direction of the impact. As illustrated in FIG. 4, the cap and products will travel towards side 34** of the carton.

Therefore, as the momentum of the products and caps carries caps 10 and 20 towards side 34 of carton 30, skirt 22 will be flexed against its resistance and bend towards product positioning structure 18. Further, the resistance of the top edge 24 opposes the flexing of skirt 22 and thusly decelerates the cap 10 and products 16 and **16*a*. In other words, as the cap moves towards the side of the carton, the resistance in skirt 22 and top edge 24** will oppose the momentum of the cap, absorb energy, decelerate the products.

FIG. 5 illustrates the effect of the connected corners in the deceleration of the cap and product. As skirt 22 along side 42 flexes towards product positioning structure 18 the inward flexing of this side 42 of skirt 22 is transmitted through the corners 41 and 43 to the sides 40 and 44 of skirt 22, respectively. In response, the sides 40 and 44 of the skirt attempt to flex outward and away from base 12 in the directions 62 and 64, respectively. However, although sides 40 and 44 of skirt 22 are urged outward, the sides 37 and 39 of carton 30, respectively, will prevent that outward motion. Thus, transmission of the motion of one side of the skirt to neighboring sides of the skirt provides yet another opposing force to the movement of cap 10, in addition to the strain in skirt 22 on side 42 and top edge 24 on side 42. These opposing forces absorb energy and decrease the velocity and momentum of the product.

The concave shape of the sides of the skirt further promotes deceleration of the product. First, because the corners will receive the initial force of the impact rather than the middle portions 50 of the skirt, the initial impact is directed down the sides of the cap, rather than towards the center where the products are positioned. Second, the outer edges of the corners will begin to deform before the rest of the skirt. The connection between the top edge of the product positioning structures 18 and the skirt 22 will not fully begin resisting the movement of the cap until after the outer edges of the corners have initially deformed. Therefore, another opposing force is provided, in addition to the resistance of top edge 24 to strain. Third, if the impact is perpendicular to the side of the skirt, as shown in FIG. 5, then as side 42 of skirt 22 moves towards side 34 of the carton, the corners 43 and 41 will tend to be pushed away from the middle portion 50, due to the concave nature of the skirt. The resistance of the skirt will oppose this reaction of the corners and the carton will resist the movement of the corners. Consequently, as the concave sides bend upon impact, yet another aspect of cap 10 provides assistance in the deceleration of the product. Fourth, if the impact occurs directly on a corner (not shown), the concave sides will also help decelerate the product by supporting the corner. In addition to the effects mentioned above, the concave shape of the two neighboring skirt sides connected to the corner will bend around the middle portions 50. As the skirt sides bend in the middle, the rigidity of the material will resist this bending, and provide additional opposing and decelerating force.

The rounded nature of the corners 41, 43, 45, and 47 assists the safe deceleration of the product. First, the rounded corner distributes the force to neighboring sides of skirt 22. If the corners of the outer edges of the skirt came to a right angle at the corner of the carton, then an impact to the corner would be transmitted directly towards the center of the cap, and, hence, directly towards the product. The rounded corners of the present invention do not directly abut the corner edge of the carton, but contact the sides of the carton at a spaced distance from the corner, as seen in FIG. 5. Thus, an impact to the corner of the carton will not be transmitted towards the center of the cap and the products, but will instead be transmitted along the sides of the cap and skirt 22. Second, if the corners met at right angles, the tips of the corners might fold upon impact in an unpredictable way, and possibly adversely affect the ability of the corner to distribute an impact to the sides upon subsequent impacts. Third, if the carton were dropped on a corner, the space between the carton corner and the cap corner would allow the carton corner to crush inwardly and absorb energy on severe impacts before the cap corner begins to deform. Fourth, a rounded corner is more likely to deform and absorb energy than a sharp right-angle corner made of the same material.

As shown in FIGS. 4 and 5, the cap 10 will continue traveling and decelerating in the opposite direction of the impact 60 until one of two events occurs. In the first event, the impact will not be severe, and the strain in skirt 22, the strain in top edge 24, the pushing of sides 40 and 44 of the skirt against the sides of the carton 37 and 39, the bending of the concave sides, and the other opposing forces will gradually slow cap 10 to a stop before it travels completely through the space 28.

In the second event, the impact will be severe, and skirt 22 will be pushed all the way through space 28 and up against carton side 34, and the impact will be transmitted directly against product positioning structure 18. The resistance within the top 75 of product positioning structure 18 will operate to cushion product **16*a* from the impact. At this point, the cap and products will already be substantially slowed, and the product positioning structures 18 do not have to provide much cushioning. Depending on the severity of the impact, the momentum of the products and the base may cause base 12 to continue towards carton side 34 until the base hits skirt 22. If base 12 hits skirt 22, inner wall 19 of spacer 21 will be in contact with skirt 22. At this point, although recycled paper fiber is not very resilient across its thickness, the combined thickness of skirt 22 and inner wall 19 will have some cushioning effect. Consequently, if inner wall 19 and skirt 22 come into contact, further cushioning effect will be translated to product 16*a* via inner wall 19. If neither spacer 21 nor product positioning structures 18** were between the product and the spring-action skirt, the product would receive a possibly damaging blow when the skirt was compressed against the product. In other words, the skirt will not bottom out against the product.

After the cap comes to a stop following the impact, the resiliency of the cap at the various strain points throughout the skirt will cause the cap to gradually recover its rest position. Thus, the cap will be prepared to protect the products from subsequent impacts. The product is held in place by the product positioning structures 18 throughout the entire deceleration and recovery process.

As outer edge 26 of skirt 22 is below the base plane as shown in FIG. 3, protection is also provided for cushioning from blows to the tops and bottoms of the carton. When the cap 10 is placed in a carton 30, base 12 is a spaced distance 29 above bottom 33 of carton 30. If the carton is dropped on bottom 33, the carton will receive an impact towards carton top 31 Consequently, the momentum of the product during the fall will continue in the opposite direction of the impact after the carton hits the floor. As the base 12 travels downwards towards carton bottom 33 through space 29, a strain will be incurred throughout skirt 22, and the skirt will oppose this motion and decelerate base 12 and products 16 and **16*a*. If base 12 travels completely through space 29, lower ribs 13 will crush and expand and provide an additional opposing resilient force. Finally, the thickness of base 12 itself will provide some cushioning effect. In any event, the resilience of the skirt will eventually restore the product to the rest position shown in FIG. 3 in preparation for another impact. Use of both caps 10 and 70** essentially places the product in resilient suspension in three dimensions.

A variety of factors may be considered when designing a packaging system for a product. For example, the size, shape, and weight and impact rating of the product itself have a bearing on how much protection a product requires. Further, the height from which the package may be dropped may also be considered.

As can be seen from the above operation illustrated in FIGS. 4 and 5 and discussed above, a number of factors will affect the deceleration of the product. For example, two of the factors which will affect the safe deceleration of the product are the amount of space 28 through which the cap has to travel, and the slope of the skirt. These two factors are inversely related to one another. For example, as the slope of skirt 22 approaches 90 degrees, the space 28 becomes smaller, and the product and cap have less distance through which to decelerate. However, as the slope of skirt 22 approaches zero degrees, i.e., parallel with the base plane, there is a greater chance that the skirt will not bend, but will instead merely fold upon itself. If the skirt folds upon itself, its resilience advantages will be diminished, and its ability to recover its rest position after the impact will be lost. Further, even if the skirt did not fold, it might transmit the impact directly across top 75 of product positioning structures 18 to the products. Accordingly, the slope of skirt 22 should be between 45 degrees and 80 degrees, and preferably, between 60 degrees and 75 degrees. Preferably, in the case of concave sides, the slope at the corners will be 60 degrees, and the slope at the midpoints will be 75 degrees.

Other elements of the package may be tailored to the requirements of the product. Some of the features of the cap which may be varied to adapt to the size and shape of the product include the size and shape of the base, and the size, shape, and number of product positioning structures. Some of the features of the cap which may be varied to adapt to the impact rating and weight of the product includes the length of the skirt, the shape of the outer edges of the skirt, the shape and radius of the corners, the amount of the space between the skirt and the side of the carton, the slope of the skirt, and the amount of space between the bottom of the base and the bottom of the carton. For example, for heavy objects with high impact ratings, a quick deceleration may be acceptable. Thus, the rigidity of the material could be increased, the space between the skirt and side of the carton may be decreased, and the slope of the skirt may be increased. On the other hand, light products with low impact ratings might require less opposing forces. Where the packaged product is a computer terminal 16 and its pedestal 16*a*, where the products are capable of withstanding impacts equal to 50 to 80 Gs, where the combined weight of the products is between about 20 and 30 pounds (9–14 kg), and where drops of 42 inches can be expected, recycled paper fiber material and the angles discussed above are preferable. Further, the base 12 is preferably about 14.5 inches wide, about 16 inches long, and about 0.25 inches thick. Also, the dimensions of the outer edges surrounding the cap are preferably 21 inches by 21 inches, and the length of the skirt 22 is about 3.5 inches at its shortest point between top edge 24 and outer edge 26. The bursting strength of the corrugated cardboard of carton 30 is preferably 275 pounds per square inch. Under these parameters, although the carton may sustain an impact of greater than 700 Gs, the products would only receive an impact, between 50 to 80 Gs. Preferably, the caps 10 and 70 are used with products weighing between 10 and 100 pounds. In another preferred embodiment, the protective packaging protects products with an impact rating of 30 Gs or higher from drops of about 36 inches or greater.

The use of molded recycled fiber is not only desirable for its rigid yet resilient characteristics, but also because it is a productive use of recycled paper, and is thus attractive to environment conscience businesses and consumers. Not only can molded recycled fiber be made from recycled materials, but the packaging itself may be recycled along with other paper products. If the packaging caps are not recycled, they will still biodegrade in the landfills. In addition, because recycled fiber can be molded into different shapes, the shapes traditionally used by expanded polystyrene packaging can be effectively emulated. Further, moldable recycled fiber is readily available, and cost effective to use in place of foam.

Many configurations of the cap according to the present invention are possible. Instead of the outer edges of the skirt extending below the base plane, the outer edges of the skirt may alternatively extend to an area above the base plane, but beyond the perimeter of the base. Although the skirt will not provide protection from vertical impacts, such as those occurring to the top or bottom of the carton, the cushioning effects of ribs 13 and base 12 will provide Vertical protection.

Figure 6:
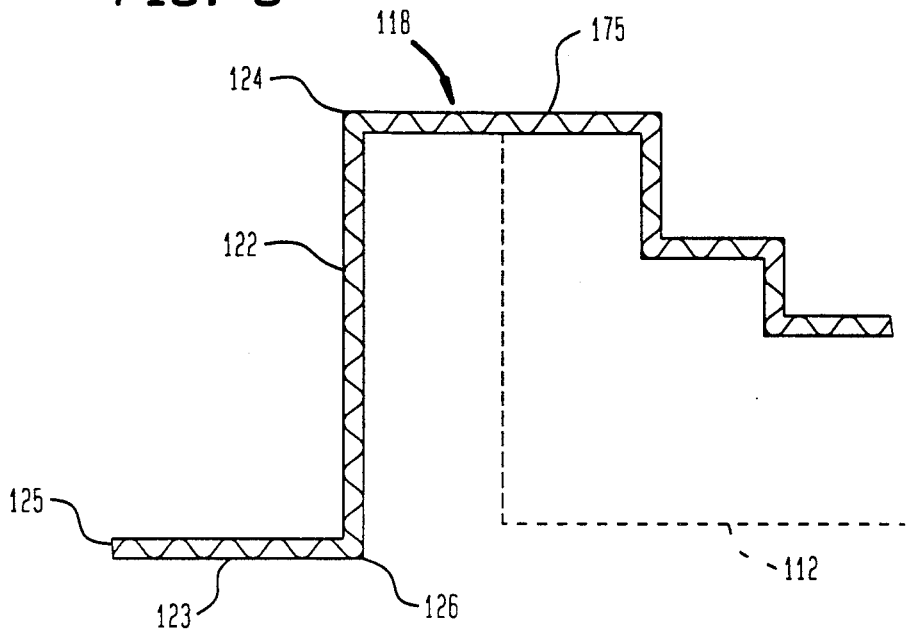
FIG. 6 is a side view of another preferred embodiment of the present invention in a carton.

Although skirt 22 is shown in FIG. 3 as coming down at an angle from product positioning structure 18, the skirt may instead have the cross-sectional structure shown in FIG. 6. In this preferred embodiment, skirt 122 extends substantially downward from top edge 124, and is substantially perpendicular to top 175 of product positioning structure 118. At the outer edge 126 of skirt 122 is flange 123. Flange 123 is substantially perpendicular to skirt 122, and extends outwards from base 112 to an outer edge 125. The flange is relatively stiff and thick, so that flange 123 will not fold or bend upon impact. In operation, outer edge 125 of flange 123 will receive the shock from an impact, and transmit the force of that impact directly across the flange to outer edge 126, and skirt 122 will operate in a similar manner as skirt 22 of FIGS. 1–5. Variations in the angle between skirt 122 and the top 175 of product positioning structure 18 and the angle between skirt 122 and flange 123 are possible. The operative slope of a skirt 122 with a flange 123 is measured from the outer edge 125 of the flange to the top edge 124. For example, FIG. 6 shows an angle of 90 degrees between the skirt and flange. Although it is not shown, the flange could be added to the skirt even if the skirt is at an angle such as shown FIG. 3.

Other configurations of a cap according to the present invention are also possible. For example, the top edge 24 of the preferred embodiment of FIG. 1 does not have to be disposed outside the perimeter of base 12, but can be directly on or within the perimeter of the base, as long as outer edge 26 is outside of the perimeter. Also, the skirt may not extend around all four sides of the base, but may be present on only two or three adjacent sides of the base, depending on the needs of the application.

Figure 7:
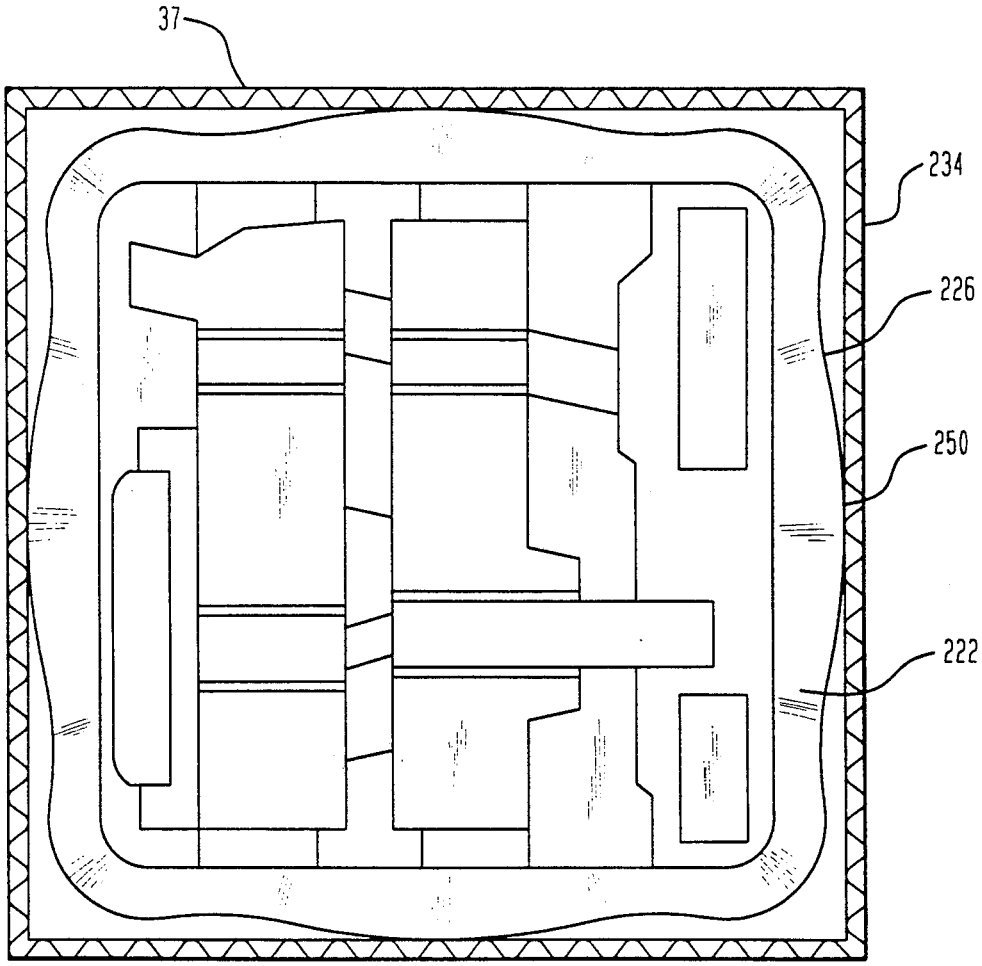
FIG. 7 is a top view of another preferred embodiment of the present invention in a carton.

Another preferred embodiment includes convex rather than concave sides, as shown in FIG. 7. The corners of the concave-sided cap described above will provide substantial protection for heavy products dropped from relatively high elevations. For lighter products, convex sides, whereby the middle portions 250 of the outer edges 226 of skirt 222 extend farther beyond the perimeter the base than the rest of the outer edges along that side of the skirt, will provide sufficient protection. With convex sides, the outer edge 226 contacts the side 250 of the carton at the middle portion 250. Immediately after impact, the skirt will easily bend in the middle portion 250 as the cap is carried towards the side of the carton. As the cap continues towards the side of the carton, a greater length of the outer edge 226 will come in contact with carton side 250, and the product will further decelerate. Eventually, all the opposing forces discussed above with regard to the embodiment of FIGS. 1–3 will decelerate the product at a safe rate, although the opposing forces provided by the concave sides and associated corners will be absent. However, for low drops of light products, the opposing forces of the corners may not be necessary.

It is also possible that only one cap is used along a side of the carton, and some sort of resilient material, such as foam, cellulose wadding, or layers of single-face corrugated paper, is used at the top.

The placement of the caps 10 and 70 along the tops and bottoms of the carton 30 are for reference purposes only. The use of two caps functions equally well when placed along the left and right sides or front and rear sides, as long as the caps are placed along opposing sides of the carton.

As these and other variations and combinations of the features described above can be utilized without departing from the present invention as defined in the appended claims, the foregoing description of the preferred embodiments should be understood as being illustrative rather than as limiting the invention as defined in the claims.

I claim:

1. A package comprising:

a rigid container having a plurality of sides, a bottom and a top defining a chamber, a cap having a base, a plurality of product positioning structures, and a plurality of resilient spring walls, said base having a top, bottom, and a plurality of edges, said plurality of edges defining a perimeter, said plurality of product positioning structures disposed along said plurality of edges of said base, each such product positioning structure having a bottom connected to said base and a top disposed above said base, said product positioning structures and said base cooperatively defining a product cavity for positioning a product within said product cavity, said plurality of resilient spring walls extending alongside said edges of said base, each spring wall having an inner edge and an outer edge, said inner edge of each said spring wall connected to the tops of said product positioning structures, said spring walls extending downwardly and outwardly from said tops of said product positioning structures so that the outer edge of each said spring wall is disposed outside of said perimeter of said base, at least two of said spring walls joining one another at a corner, whereby said cap is disposed within said chamber of said container and along said bottom of said container, and if the rigid container is impacted in an impact direction, base travels in a direction opposite the impact direction towards said one of said sides of said container, and a portion of said spring walls compresses towards said product positioning structures thereby decelerating the product.

2. A package of claim 1 wherein the outer edge of one said spring wall connects the outer edge of another said spring wall at each said corner.

3. A package of claim 2 wherein each outer edge of each said spring wall has a first end and a second end, at least one said end disposed next to one of said corners, said spring wall being concave in a direction toward said base between said first end and said second end.

4. A package of claim 2 wherein each outer edge of each said spring wall has a first end and a second end, at least one said end disposed next to one of said corners, said spring wall being convex in an outward direction from said base between said first end and said second end.

5. A package of claim 2 wherein each outer edge of each said spring wall has a first end and a second end, at least one said end disposed next to one of said corners, said outer edges of said spring wall being straight between said first end and said second end.

6. A package of claim 1 wherein said container is made of corrugated cardboard.

7. A package of claim 6 wherein the bursting strength of said corrugated cardboard is 275 pounds per square inch.

8. A package of claim 6 wherein said cap is made of molded paper fiber.

9. A package of claim 1 further comprising a resilient product cushion, whereby said cap is placed along said bottom of said container and said product cushion is placed along said top of said carton, and said product is disposed within the product cavity of said cap and against said product cushion such that said product is resiliently suspended within said chamber of said container between said cap and said product cushion.

10. A package of claim 9 wherein the structure of said product cushion has identical structure to said cap.

11. A package of claim 10 wherein said cap and said product cushion are capable of protecting products with impact ratings of 30 Gs or greater when said package is dropped from a height of about 36 inches or greater.

12. A package of claim 1 wherein said corners are rounded.

13. A package of claim 3 or 4 wherein said base defines a base plane, and the slope of said spring walls with respect to said base plane is between about 45 degrees and 80 degrees.

14. A package of claim 1 further comprising spacer structures, said spacer structures disposed between said product positioning structures and having an inner wall rising out of said perimeter of said base, said spring walls being capable of contacting said inner walls if flexed towards said base.

15. A shock absorbant cap comprising:

a base having a top, bottom, and a plurality of edges, said plurality of edges defining a perimeter, a plurality of product positioning structures disposed along said plurality of edges of said base, each such product positioning structure having a bottom connected to said base and a top disposed above said base, said product positioning structures and said base cooperatively defining a product cavity for positioning a product within said product cavity, a plurality of resilient spring walls extending alongside said edges of said base, each spring wall having an inner edge and an outer edge, said inner edge of each said spring wall connected to the tops of said product positioning structures, said spring walls extending downwardly and outwardly from said tops of said product positioning structures so that the outer edge of each said spring wall is disposed outside of said perimeter of said base, at least two of said spring walls joining one another at corners, and each outer edge of each said spring wall having a first end and a second end, at least one said end disposed next to one of said corners, said spring wall being convex in an outward direction from said base between said first end and said second end.

16. A cap of claim 15 wherein the outer edge of one said spring wall connects the outer edge of another said spring wall at each said corner.

17. A cap of claim 15 wherein a of said base defines a base plane, and said outer edges extend below said base plane such that said outer edges are closer to said bottom of said base than said top of said base.

18. A cap of claim 15 wherein said cap is made of molded paper fiber.

19. A cap of claim 15 wherein the number of said plurality of edges of said base is four, and the number of said plurality of said spring walls is four.

20. A cap of claim 19 wherein said product weighs between about 10 and 100 pounds.

21. A cap of claim 20 wherein said base is about 14.5 inches wide, about 16 inches long, and about 0.25 inches thick, and the dimensions of the outer edges of said skirt are 21 inches by 21 inches, and said skirt is about 3.5 inches long at its shortest point between said product positioning structures and said outer edge.

22. A cap of claim 15 wherein said corners are rounded.

23. A cap of claim 22 wherein the radius of at least one said corner at the outer edge is greater than the radius of such corner closer to said product positioning structures.

24. A cap of claim 23 wherein the radius of at least one said corner progressively decreases from said outer edge of such corner towards said product positioning structures.

25. A cap of claim 15 wherein said base defines a base plane, and the slope of said spring walls with respect to said base plane is between about 45 degrees and 80 degrees.

26. A cap of claim 25 wherein the slope of at least one of said spring walls progressively increases towards said first and second ends of said outer edges of such spring wall, and progressively decreases towards the midpoint of said outer edges between said first and second ends.

27. A cap of claim 25 wherein said slope of said spring walls at every point is between about 60 degrees to 75 degrees.

28. A cap of claim 15 wherein said spring wall comprises a skirt and a flange, said skirt extending downwardly from said inner edge of said spring wall to a bottom which is a spaced distance from said perimeter of said base, said flange connected to said bottom of said skirt, and extending to said outer edge of said spring wall, whereby said flange and said skirt form an angle.

29. A cap of claim 28 wherein said angle between said flange and said skirt is between about 90 degrees and 135 degrees.

30. A cap of claim 15 further comprising spacer structures, said spacer structures disposed between said product positioning structures and having an inner wall rising out of said perimeter of said base, said spring walls being capable of contacting said inner walls if flexed towards said base.

31. A shock absorbant cap comprising:

a base having a top, bottom, and a plurality of edges, said plurality of edges defining a perimeter, a plurality of product positioning structures disposed along said plurality of edges of said base, each such product positioning structure having a bottom connected to said base and a top disposed above said base, said product positioning structures and said base cooperatively defining a product cavity for positioning a product within said product cavity, a plurality of resilient spring walls extending alongside said edges of said base, each spring wall having an inner edge and an outer edge, said inner edge of each said spring wall connected to the tops of said product positioning structures, said spring walls extending downwardly and outwardly from said tops of said product positioning structures so that the outer edges of each said spring wall is disposed outside of said perimeter of said base, at least two of said spring walls joining one another at corners, and the outer edge of at least one of said corners being rounded.

32. A cap of claim 31 wherein the outer edge of one said spring wall connects the outer edge of another said spring wall at each said corner.

33. A cap of claim 31 wherein a majority of said base defines a base plane, and said outer edges extend below said base plane such that said outer edges are closer to said bottom of said base than said top of said base.

34. A cap of claim 31 wherein said cap is made of molded paper fiber.

35. A cap of claim 31 wherein the number of said plurality of edges of said base is four, and the number of said plurality of said spring walls is four.

36. A cap of claim 35 wherein said product weighs between about 10 and 100 pounds.

37. A cap of claim 30 wherein said base is about 14.5 inches wide, about 16 inches long, and about 0.25 inches thick, and the dimensions of the outer edges of said skirt are 21 inches by 21 inches, and said skirt is about 3.5 inches long at its shortest point between said product positioning structures and said outer edge.

38. A cap of claim 31 wherein the radius of at least one said corner at the outer edge is greater than the radius of such corner closer to said product positioning structures.

39. A cap of claim 38 wherein the radius of at least one said corner progressively decreases from said outer edge of such corner towards said product positioning structures.

40. A cap of claim 31 wherein the outer edge of each said spring wall has a first end and a second end, at least one said end disposed next to one of said corners, said spring wall being concave in a direction toward said base between said first and second end.

41. A cap of claim 40 wherein said base defines a base plane, and the slope of said spring walls with respect to said base plane is between about 45 degrees and 80 degrees.

42. A cap of claim 41 wherein the slope of at least one of said spring walls progressively decreases towards said first and second ends of said outer edges of such spring wall, and progressively increases towards the midpoint of said outer edges between said first and second ends.

43. A cap of claim 41 wherein said slope of said spring walls at every point is between about 60 degrees to 75 degrees.

44. A cap of claim 43 wherein the slope at said midpoint of said outer edges is about 75 degrees, and the slope at said corners is about 60 degrees.

45. A cap of claim 31 wherein said spring wall comprises a skirt and a flange, said skirt extending downwardly from said inner edge of said spring wall to a bottom which is a spaced distance from said perimeter of said base, said flange connected to said bottom of said skirt and extending to said outer edge of said spring wall, whereby said flange and said skirt form an angle.

46. A cap of claim 45 wherein said angle between said flange and said skirt is between about 90 degrees and 110 degrees.

47. A cap of claim 31 further comprising spacer structures, said spacer structures disposed between said product positioning structures and having an inner wall rising out of said perimeter of said base, said spring walls being capable of contacting said inner walls if flexed towards said base.

48. A package comprising a rigid container having a plurality of sides, a bottom and a top defining a chamber, a cap having a base, a plurality of product positioning structures, and a plurality of resilient spring walls, said base having a top, bottom, and a plurality of edges, said plurality of edges defining a perimeter, said plurality of product positioning structures disposed along said plurality of edges of said base, each such product positioning structure having a bottom connected to said base and a top disposed above said base, said product positioning structures and said base cooperatively defining a product cavity for positioning a product within said product cavity, said plurality of resilient spring walls extending alongside said edges of said base, each spring wall having an inner edge and an outer edge, said inner edge of each said spring wall connected to the tops of said product positioning structures, said spring walls extending downwardly and outwardly from said tops of said product positioning structures so that the outer edge of each said spring wall is disposed outside of said perimeter of said base, at least two of said spring walls joining one another at a corner, the outer edge of at least one of said corners being rounded, and a resilient product cushion, said cap being placed along said bottom of said container and said product cushion being placed along said top of said container whereby a product may be disposed within the product cavity of said cap and against said product cushion such that said product is resiliently suspended within said chamber of said container said cap and said product cushion, and whereby if the rigid container is impacted in an impact direction, base travels in a direction opposite the impact direction towards said one of said sides of said container, and a portion of said spring walls compresses towards said product positioning structures thereby decelerating the product.

49. A package of claim 48 wherein each outer edge of each said spring wall has a first end and a second end, at least one said end disposed next to one of said corners, said spring wall being concave in a direction toward said base between said first end and said second end.

50. A package of claim 48 wherein each outer edge of each said spring wall has a first end and a second end, at least one said end disposed next to one of said corners, said spring wall being convex in an outward direction from said base between said first end and said second end.

51. A package of claim 48 wherein each outer edge of each said spring wall has a first end and a second end, at least one said end disposed next to one of said corners, said outer edges of said spring wall being straight between said first end and said second end.

* * * * *

UNITED STATES PATENT AND TRADEMARK OFFICE

CERTIFICATE OF CORRECTION

PATENT NO. : 5,259,508
DATED : November 9, 1993
INVENTOR(S) : Stephen M. Beckerman It is certified that error appears in the above-indentified patent and that said Letters Patent is hereby corrected as shown below:

Column 5, line 58 "20" should read --70--.
Column 5, line 59 "20" should read --70--.
Column 5, line 62 "20" should read --70--.
Column 6, line 19 "20" should read --70--.
Column 6, line 27 after "ergy," insert --and--.
Column 8, line 15 after "31" insert --.--.
Column 9, line 56 "Vertical" should read --vertical--.
Column 10, line 32 after "perimeter" insert --of--.
Column 11, line 28 delete "said" (first occurrence).
Column 12, line 47 after "wherein a" insert --majority--.
Column 14, line 6 "30" should read --36--.
Column 16, line 5 delete "said" (first occurrence).

Signed and Sealed this

Nineteenth Day of April, 1994

Bruce Lehman

*Attest:*

BRUCE LEHMAN

*Attesting Officer*

*Commissioner of Patents and Trademarks*